United States Patent [19]

Apissomian

[11] Patent Number: 4,905,612

[45] Date of Patent: Mar. 6, 1990

[54] FURNITURE CONSTRUCTION WITH FOLDING LEG ASSEMBLY

[75] Inventor: Arthur A. Apissomian, Wadena, Minn.

[73] Assignee: Homecrest Industries Incorporated, Wadena, Minn.

[21] Appl. No.: 267,719

[22] Filed: Nov. 4, 1988

Related U.S. Application Data

[63] Continuation of Ser. No. 120,389, Nov. 13, 1987, abandoned.

[51] Int. Cl.[4] ..... A47B 3/06

[52] U.S. Cl. ..... 108/157; 248/167

[58] Field of Search ..... 108/157, 115, 154, 103, 108/139, 27, 102, 150, 153, 158; 297/42; 248/188.6, 167

[56] References Cited

U.S. PATENT DOCUMENTS

| | | | |
|---|---|---|---|
| 1,145,505 | 7/1915 | Orear . | |
| 1,259,580 | 3/1918 | Wurz | 108/115 X |
| 1,617,352 | 2/1927 | Smith | 248/168 X |
| 1,652,942 | 12/1927 | James | 248/167 X |
| 1,697,094 | 1/1929 | Türk . | |
| 1,800,685 | 4/1931 | Griffis . | |
| 1,939,904 | 12/1933 | Koopman | 108/157 |
| 2,010,342 | 8/1935 | Woods | 108/157 |
| 2,086,380 | 7/1937 | Flagstad | 311/80 |
| 2,190,623 | 2/1940 | Benson | 248/167 X |
| 2,591,797 | 4/1952 | Exline et al. | 108/115 X |
| 2,791,477 | 5/1957 | Wesbecher | 311/80 |
| 2,792,491 | 5/1957 | Rand | 108/115 X |
| 3,094,951 | 6/1963 | Levinson | 108/103 |
| 3,267,889 | 8/1966 | Bedol | 108/157 |
| 3,366,079 | 1/1968 | Koransky et al. | 108/157 |
| 3,387,808 | 6/1968 | Metcalf | 248/46 |
| 3,811,673 | 5/1974 | Baker | 108/27 X |
| 4,169,625 | 10/1979 | Petersen | 248/425 X |
| 4,226,398 | 10/1980 | Freber | 108/139 X |
| 4,288,052 | 9/1981 | Scott | 248/188.6 |
| 4,315,467 | 2/1982 | Vanderminden | 108/157 |

FOREIGN PATENT DOCUMENTS

| | | | |
|---|---|---|---|
| 1087568 | 8/1960 | Fed. Rep. of Germany | 248/167 |
| 569447 | 11/1975 | Switzerland | 108/157 |
| 652211 | 4/1951 | United Kingdom | 108/157 |
| 1079513 | 8/1967 | United Kingdom | 108/115 |

*Primary Examiner*—José V. Chen

*Attorney, Agent, or Firm*—Kinney & Lange

[57] ABSTRACT

A furniture construction includes a floor-engaging base for supporting a panel member. The floor-engaging base includes first and second leg assemblies, each leg assembly having first and second spaced-apart leg members that are connected by upper and lower cross members. Each pair of upper and lower cross members are rotatably connected to each other by a disk assembly including first and second disks that are in rotatable cooperation with each other and which are fixedly attached to the corresponding pair of cross members.

5 Claims, 2 Drawing Sheets

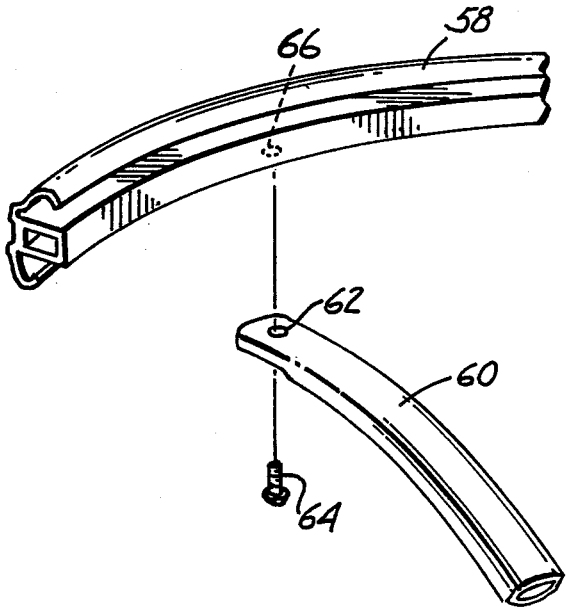
Fig. 4
Fig. 5
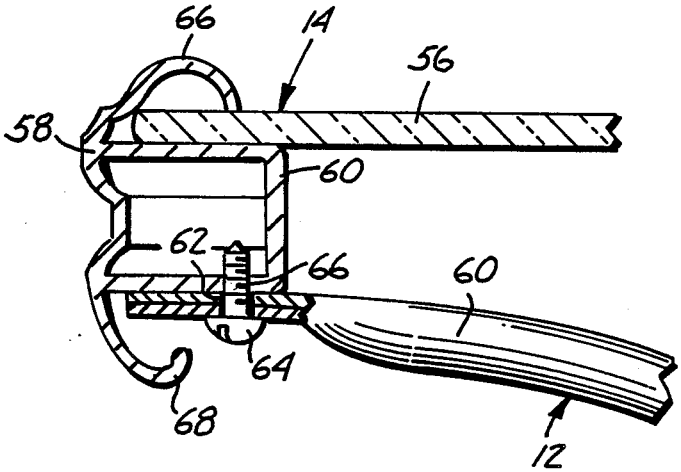

FURNITURE CONSTRUCTION WITH FOLDING LEG ASSEMBLY

This is a continuation of application Ser. No. 07/120,389, filed Nov. 13, 1987 (now abandoned).

BACKGROUND OF THE INVENTION

1. Field of the Invention

The present invention relates to the construction of furniture, and in particular, it relates to a table having a folding leg assembly.

2. Description of the Prior Art

Tables and like furniture have always presented shipping problems. When a table is shipped in an assembled state, the table occupies a large volume. When the table is shipped in a disassembled state, the table must then be assembled at the point of destination, or by the end user. There have been a number of attempts to make table constructions that are more convenient for transportation, assembly, disassembly and storage.

The Orear U.S. Pat. No. 1,145,505 describes a table having a lower floor-engaging base with a pair of leg sections set at right angles to each other. A pin permits the leg sections to rotate with respect to each other.

The Turk U.S. Pat. No. 1,697,094 describes a folding table having three legs that are positioned 120° from each other. The legs are attached to a centrally-located bracket and are foldable into a flat position.

The Griffis U.S. Pat. No. 1,800,685 describes a table having two pairs of legs, one pair of legs extending through a cut-out in the frame of the other pair of legs. The legs are pivotally attached with respect to each other via a central locking bolt.

The Woods U.S. Pat. No. 2,010,342 describes a folding table arrangement that includes two pairs of legs, one pair extending through the framework of the other pair. The pairs of legs are pivotally attached to each other through upper and lower bolts that extend through cross members of each pair of legs.

The Flagstad U.S. Pat. No. 2,086,380 describes a folding table having first and second leg pairs, each leg pair having an upper and lower cross brace. The leg pairs extend through each other and are foldable through centrally-located pivot pins 21 and 22 that pivotally connect the cross members of each leg pair to each other.

The Exline et al U.S. Pat. No. 2,591,797 describes two table leg arrangements. The first arrangement has two leg pairs disposed 90° to each other, each leg pair having upper and lower cross braces, disposed 90° with respect to each other. The cross braces are attached to each other by a nut and bolt. The other arrangement also includes cross braces that are disposed 90° with respect to each other and are secured in such a position by interlocking recesses. The cross braces are attached to respective lower leg portions that are connected by a centrally-located bolt.

The Wesbecher U.S. Pat. No. 2,791,477 describes a foldable table with a hinged top and four legs that are held within a centrally-located bracket. One leg is held in a fixed position with respect to the others while the other legs are pivotally held within the bracket.

The Koransky et al U.S. Pat. No. 3,366,079 describes a foldable table having four legs held within a centrally-located bracket assembly. The legs are pivotally held within the bracket assembly. Similarly, the Vanderminden U.S. Pat. No. 4,315,467 describes a collapsible cocktail table that includes three legs which are pivotally secured together by a bracket.

Both the Scott U.S. Pat. No. 4,288,052 and the Metcalf U.S. Pat. No. 3,387,808 illustrate the use of hubs or rings to which leg members are attached. In these two patents, the rings must be vertically displaced along the axis of the support posts in order for the legs to be folded.

The Scott Patent teaches a collapsible stand having two pairs of opposed legs extending from a hub support, the inner ends of the legs being sandwiched between a pair of discs that surround the central hub. The stand is collapsed or set up by rotating one pair of legs relative to the other. Detenting tabs are used to lock the legs in place. In operation, the leg segments ride up the inclined tabs and fall into the locking slots.

The Metcalf Patent describes a collapsible support structure having a central axis about which a pair of leg members rotate, one pair of legs being fixed to the central axis, the other fixed to a rotating collar. The rotating legs must move vertically to be aligned in their locked position where the legs abut against adjoining inner portions of the legs.

SUMMARY OF THE INVENTION

The present invention includes a furniture construction having a floor-engaging base for supporting a panel member. The floor-engaging base includes first and second leg assemblies. Each leg assembly has first and second spaced-apart leg members connected by upper and lower cross members. A first means for rotatably connecting the upper cross members of the first and second leg assemblies is disposed between the upper cross members. A second means for rotatably connecting the lower cross members of the first and second leg assemblies is disposed between the lower cross members. Each means for rotatably connecting includes first and second disks in rotatable cooperation with the first disk being fixedly attached to one respective cross member and a second disk being fixedly attached to the other respective cross member.

BRIEF DESCRIPTION OF THE DRAWINGS

FIG. 4 is an exploded fragmentary view of attachment means of the leg member to the rigid rim in the preferred embodiment of the present invention.

FIG. 5 is an enlarged fragmentary cross-sectional view of the leg member and panel member attachment to the rim in the preferred embodiment of the present invention.

DETAILED DESCRIPTION OF THE PREFERRED EMBODIMENTS

Figure 1:
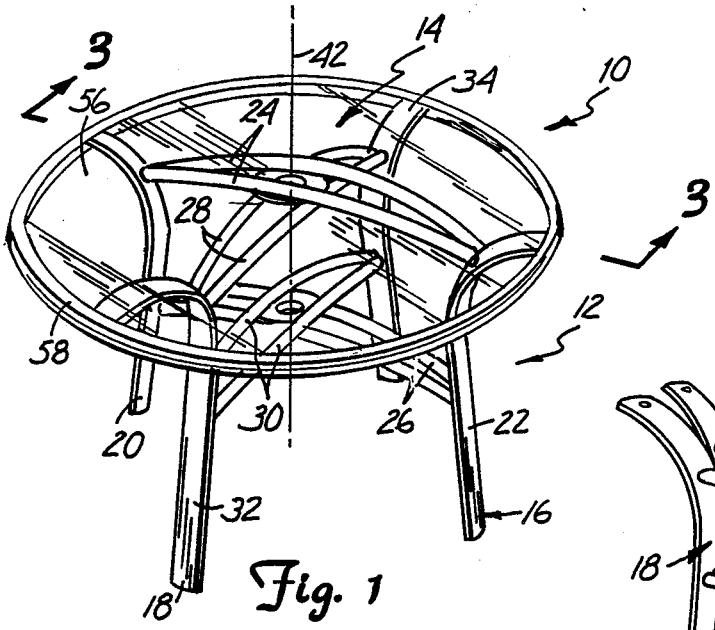
FIG. 1 is a perspective view of the table of the present invention.

In the drawings, like reference numbers will be used to indicate like elements. A table of the present invention is generally indicated at 10 in FIG. 1. The table 10 includes a floor-engaging base 12 supporting a table top 14.

The floor engaging base 12 includes an outer leg assembly 16 and an inner leg assembly 18. The outer leg assembly 16 includes first and second spaced-apart leg members 20 and 22 connected by upper cross members 24 and lower cross members 26. The cross members 24 and 26 are connected to the leg members 20 and 22 by a suitable method such as welding. The cross members 24 and 26 are tubular in construction and made of a metal. Similarly, the leg members 20 and 22 are made of metal.

The inner leg assembly 18 is similarly constructed having upper cross members 28 and lower cross members 30 connecting spaced-apart leg members 32 and 34. The cross members 28 and 30 are fixedly attached to the leg members 32 and 34 by a suitable method, such as welding. The cross members 28 and 30 are of a tubular construction and made of metal. Similarly, the leg members 32 and 34 are made of metal.

Although two members are shown in the drawings for each upper and lower cross member, a single cross member is within the scope of the present invention.

As can be seen from FIG. 1, the cross members 28 and 30 of the inner leg assembly are disposed between the cross members 24 and 26 of the outer leg assembly.

Figure 2:
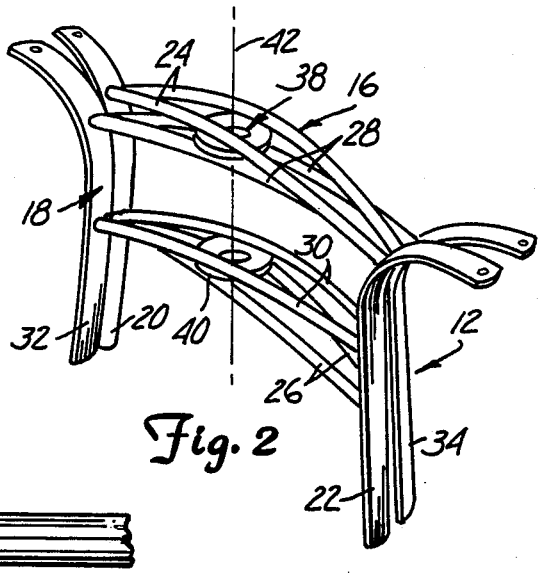
FIG. 2 is a perspective view of the present invention in its folded leg position.

The inner and outer leg assemblies are movable with respect to each other between an open locked position, as illustrated in FIG. 1, and a closed folded position, as illustrated in FIG. 2. In the folded position, the table construction of the present invention occupies less space for shipping and is easily assembled into the locked open position illustrated in FIG. 1, thereby providing economies in shipping and handling.

Upper and lower disk assemblies 38 and 40 permit movement of the leg assemblies 16 and 18 about a common axis 42 and rotatably attach the leg assemblies 16 and 18 to each other. It will be appreciated that no central post is needed in the floor-engaging base 12 so that the leg assemblies 16 and 18 are rotatable between the folded position, as illustrated in FIG. 2, and the locked position, as illustrated in FIG. 1.

Figure 3:
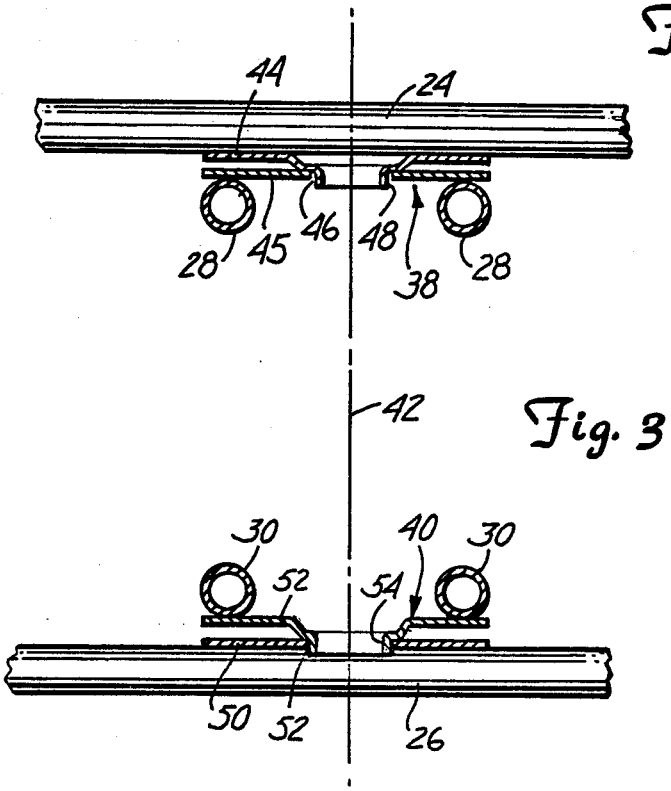
FIG. 3 is an enlarged fragmentary cross-sectional view of the disc members of the present invention taken along the lines 3—3 in FIG. 1.

The construction of the disk assemblies 38 and 40 is best illustrated in FIG. 3. The disk assembly 38 includes an upper disk 44 and a lower disk 45. The lower disk 45 has an aperture 46 and is disposed about the axis 42. The upper disk 44 has an annular lip 48 that extends through the aperture 46. The upper disk 44 and the lower disk 45 are rotatable with respect to each other through the operation of the lip 48 within the aperture 46.

Similarly, the lower disk assembly 40 includes a lower disk 50 having an aperture 52 which is disposed about the axis 42, and an upper disk 52 having an annular lip 54. The lip 54 is disposed within the aperture 52 such that the disks 50 and 52 are rotatable with respect to each other through the operation of the lip 54 within the aperture 52.

The disk 44 is fixedly attached to the upper cross members 24 of the outer leg assembly 16 by welding, screws or any other suitable manner. Similarly, the lower disk 45 is fixedly attached to the cross members 28 by welding, screws or any other suitable manner. The lower disk 50 and the upper disk 52 of the lower disk assembly 40 are also fixedly attached to the cross members 26 and 30, respectively, by welding, screws or any other suitable method.

The floor engaging base 12 is locked by locking means (62, 64, 66) in the open position, as illustrated in FIG. 1 by being secured to the table top 14. The particular table top that is illustrated in FIG. 1 includes a translucent or transparent horizontally-disposed circular top member 56 engaging a rim 58 throughout its entire circumference. The top member is made of glass or a glass-like material. As best illustrated in FIG. 4, each leg member of both the outer leg assembly 16 and the inner leg assembly 18 has an upper outwardly-extending curved end portion 60. Each outwardly-extending end portion 60 has an aperture 62 through which a self-tapping screw 64 extends to engage an aperture 66 in the rim 58. It will be understood that in the case of a wooden table top, a rim such as rim 58 may not be necessary for the present invention. The outwardly-extending end portion 60 may be directly attached to a wooden table top.

As more fully illustrated in FIG. 5, the rim 58 is made of an extrudable material having a central portion 60 which provides beam strength to the rim and which separates the floor-engaging base 12 from the table top 14. The top member 56 rests on the central portion 60 and is secured thereto by an upper curved retaining lip 66 that provides a downward force onto the top member 56. The rim 58 also includes a lower curved section 68 that provides a decorative facade to hide from view the manner in which the table top 14 and the floor-engaging base 12 are attached to each other.

The floor-engaging base is assembled by inserting the leg assembly 18 within the leg assembly 16 and placing the leg assemblies in a jig so that the cross members 24 and 28, and cross members 26 and 30 are positioned such that the leg assemblies are in the open position. The respective disk assemblies are then placed between the respective cross members. For example, the disk assembly 38 is placed between the cross members 24 and 28 with the disk member 44 welded onto the cross member 24 and the disk 45 welded onto the cross member 28. Similarly, the disk assembly 40 is positioned between the cross members 26 and 30. The disk 52 is welded to the cross members 30 and the disk 50 is welded to the cross member 26. With the disk assemblies welded into place, the floor-engaging base is operational.

In operation, the outer and inner leg assemblies may be urged to the closed position, as illustrated in FIG. 2, with the corresponding disks of the disk assemblies rotating with respect to each other about the axis 42. The floor-engaging base 12 is then positioned in a relatively flat box along with the table top 14 for shipping to the end user. Upon receipt by the end user, the floor-engaging base 12 is placed in the open position by manually urging the outer and inner leg assemblies 16 and 18 to the open position of FIG. 1. The leg assemblies rotate about the axis 42 through the disk assemblies 38 and 40. The table top 14 is secured to the rim 58 through the outwardly-extending end portions 60 as discussed previously.

Although the present invention has been described with reference to preferred embodiments, workers skilled in the art will recognize that changes may be made in form and detail without departing from the spirit and scope of the invention.

What is claimed is:

1. A furniture construction, comprising:

a panel member;

a floor-engaging base for supporting the panel member in a substantially horizontal position, the floor engaging base including first and second leg assemblies, each leg assembly having first and second spaced-apart leg members connected by upper and lower cross member means, and first means for rotatably connecting the upper cross member means of the first and second leg assemblies to each other and second means for rotatably connecting the lower cross member means of the first and second leg assemblies to each other, the first and second means for rotatably connecting being disposed between the assemblies to each other, the first and second means for rotatably connecting being disposed between the upper and lower cross members, respectively, and each means for rotatably connecting including first and second disks with the first disk having an aperture therein and being fixedly attached to one cross member means and the second disk having an annular lip extending only through the aperture without engaging a side of the first disk and the second disk being fixedly attached to the other cross member means such that the disks are in rotatable, slidable contact with each other and such that the cooperation of the aperture and the annular lip of the first and second means for rotatably connecting and the attachment of the first and second disks to the respective cross member means retains the first and second leg assemblies in cooperating relationship while permitting rotation of the leg assemblies about a single vertical axis.

2. The construction of claim 1 and further including locking means for locking the leg assemblies to the panel member when the floor-engaging base is in an open position.

3. The construction of claim 2 wherein each of the leg members includes an upper end portion having an aperture disposed therein and through which a threaded fastener extends and threadably engages the panel member.

4. The construction of claim 3 wherein the panel member further includes a rim extending along the circumference of the panel member for threadable engagement with the threaded fastener.

5. The construction of claim 1 wherein the first and second means for rotatably connecting lie along the same axis.

* * * * *